US006446406B1

(12) United States Patent
Sauer

(10) Patent No.: US 6,446,406 B1
(45) Date of Patent: Sep. 10, 2002

(54) DIRECT ATTACHED GRID

(75) Inventor: Gale E. Sauer, Sinclairville, NY (US)

(73) Assignee: Worthington Armstrong Venture, Malvern, PA (US)

( * ) Notice: Subject to any disclaimer, the term of this patent is extended or adjusted under 35 U.S.C. 154(b) by 0 days.

(21) Appl. No.: 09/657,774

(22) Filed: Sep. 8, 2000

(51) Int. Cl.[7] ..... E04B 2/00

(52) U.S. Cl. ..... 52/506.06; 52/667; 52/573; 52/488; 287/189.36

(58) Field of Search ..... 52/506.07, 731.1, 52/731.5, 731.7, 733.1

(56) References Cited

U.S. PATENT DOCUMENTS 3,305,256 A * 2/1967 Znamirowski ..... 287/189.36
3,356,402 A * 12/1967 Smith ..... 287/189.36
3,378,976 A * 4/1968 Meredith ..... 52/573
3,511,012 A * 5/1970 Brady ..... 52/667
3,839,839 A 10/1974 Tillisch et al. ..... 52/738
3,900,997 A 8/1975 Ollinger et al. ..... 52/496
4,064,671 A 12/1977 Sauer ..... 52/696
4,208,851 A 6/1980 Sauer ..... 52/573
4,769,965 A 9/1988 Shaub ..... 52/488
4,920,719 A * 5/1990 Shaub et al. ..... 52/488

OTHER PUBLICATIONS

Brochure: Acoustic Ceiling Products, L.L.C.; "ACP Snap Tight Grid* Surface Mount Grid System".

* cited by examiner

*Primary Examiner*—Carl D. Friedman
*Assistant Examiner*—Steve Varner
(74) *Attorney, Agent, or Firm*—Eugene Chovanes

(57) ABSTRACT

In a panel ceiling, a grid that supports panels has main beams and cross beams. In assembly, the main beams are directly attached to an overhead structure and the cross beams and panels are assembled onto the main beams. Stepped slots in the main beams enable the cross beams to be locked to the main beams to keep the cross beams and panels aligned.

15 Claims, 9 Drawing Sheets

20
21
22
24
25
26
27
28
30
36
37
38
40
51
71
75
76
77

DIRECT ATTACHED GRID

BACKGROUND OF THE INVENTION

1. Field of the Invention

This invention relates to a panel ceiling having a grid framework that supports the panels. The grid is directly attached to an overhead structure such as an existing ceiling.

2. Background Art

The most common form of panel ceiling wherein a grid framework supports acoustical panels, is a suspended ceiling. Main beams of the grid are suspended on hanger wires anchored in an overhead structure. The grid, or a section thereof, of parallel main beams and interlocking, intersecting cross beams, is assembled, and hung, from the overhead structure, before the panels are inserted. In assembling the grid, the main beams can be separated and rotated as required to insert cross beam end connectors.

In such a ceiling, the hanger wires, in suspending the grid, create space between the overhead structure and the grid. This space is generally used, particularly in commercial construction, for utilities, such as air ducts and electrical conduits.

The space is also useful in connecting the cross beams to the main beams, and in placing panels into the assembled grid.

The main beams are hung by wires, and then the cross beams and main beams are maneuvered, using the space, to interlock the beams to assemble the grid. The main beams can be separated and rotated during the assembly.

In the assembled grid, the panels are inserted through the grid openings into the space above the grid, and then maneuvered into place on the grid. Sufficient space above the grid is required to so place the panels in a suspended ceiling.

A substantial body of prior art exists with respect to such suspended ceilings, since they possess many advantages and are extensively used.

A disadvantage of a suspended ceiling is that it consumes overhead space which is sometimes more needed below the ceiling than above the ceiling.

In another form of panel ceiling having a grid, the grid, through the main beams, is directly attached Go an overhead structure, eliminating the space between the overhead structure and the grid, and any use of hanger wires. Such a direct attachment is particularly desirable in residential structures where an old ceiling is being covered, in order to minimize loss of ceiling height.

In eliminating the space between the overhead structure and grid, however, other problems are created.

Whereas in the wire suspended grid, the main beams can be shifted during the installation of the cross beams, in direct attached grid, the main beams are first fixed in place, and then the cross beams are installed. The main beams cannot be shifted during a connection. Hence, the numerous different connections between the main beams and cross beams developed for suspended ceilings are not suitable for direct attached grid ceilings.

Another problem with direct attached grid ceilings, is the lack of space above the direct attached grid for placing panels. Again, this renders the extensive prior art relating to suspended ceilings inadequate to solve the problems of assembling grid, and placing panels, encountered in direct applied grid ceilings.

These problems encountered with direct applied grid have discouraged any wide spread use.

Attempts have been made to solve these problems. U. S. Pat. No. 4,920,719, incorporated herein by reference, creates space for placing panels and cross beams on the fixed main beams by the use of a stepped cross-section in the main beam which is directly attached to the ceiling. A panel is shifted into position using the space created by an upper stepped portion of such main beam, and a cross beam is then placed to help support the panel.

In the '719 patent however, a cross beam, which must be placed after a panel is in place, does not positively lock into the main beams at a predetermined location, but rather the cross beam can slide along the main beam. An installer must use judgment in locating the panels and cross beams, to keep the panels and cross beams desirably aligned to present a uniform ceiling appearance. Such a procedure is time consuming and often the end result is unsatisfactory in that the panels are misaligned, and free to shift.

The prior art connections between the main and cross beams developed for suspended ceilings do not work with direct attached grid. As described above, prior art grid connections in suspended ceilings require space to assemble the connections, and require main beam movement during assembly. Both these requirements are lacking in direct attached grid.

SUMMARY OF THE PRESENT INVENTION

In a directly attached grid, directly attached main beams are slotted in such a way that connectors on the ends of the cross beams can be locked to the main beam at factory predetermined positions on the main beam. This aligns and secures the cross beams and panels in the ceiling in an orderly and uniform manner. A stepped slot enables the cross beams to be so locked.

The stepped slot has portions that necessarily extend in the web and in the adjacent step of the stepped main beam, and optionally in the riser adjacent to that step.

In assembling the grid on site, a cross beam is locked to a stepped main beam that is directly attached to an overhead structure. The cross beam is locked to the main beam, both along the main beam, as well as laterally of the main beam, at factory predetermined positions along the main beam. There is no judgment required of the installer in positioning the cross beams and panels after the main beams are aligned, spaced, and secured to the overhead structure. The end result is a uniform, secure, easily installed ceiling, with an interlocking grid. The panels are not free to shift. The ceiling face can be installed within one and one-half inches of an existing overhead structure.

The ceiling can be disassembled, beginning at any point, and to any extent. Panels can be shifted above other panels for access to any point above the ceiling. The stepped slot of the invention further permits individual cross beams to be readily removed by vertical motion from a completed ceiling, and a given panel removed, without disturbing other panels in the ceiling.

The stepped slot of the invention exists in the main beam in a way that does no significantly reduce the strength of the main beam. The strength of the beam remains adequate to support the panels and cross beams.

The slot permits a cross beam to use the clearance created by the stepped beam to position and lock the cross beam to the main beam.

The stepped slot likewise permits the necessary clearance to unlock a cross beam from the main beam to permit an adjacent panel to be removed from a completed ceiling.

The horizontal portion of the stepped slot is critical to the invention, since it permits the connector on the cross beam to be shifted downward from its position above the step to hook onto the web. Main beam separation or twist is not necessary to achieve this connection.

The grid system of the invention can optionally be produced of metal, or of plastic. Where the grid is produced of plastic, the main and cross beam may be extruded to produce, for each, a uniform profile. The slots and the connectors are then formed by a cutting, in a stamping operation. The connectors are then offset, again in the stamping operation. Since the main beams are attached directly to an upper structure, the necessary rigidity of the grid is obtained from such upper structure. The stepped slot of the invention, wherein material is removed from the main beam, does not significantly detract from the strength obtained in the grid system by attaching the main beams directly to the overhead structure.

BRIEF DESCRIPTION OF THE SEVERAL VIEWS OF THE DRAWINGS

FIG. 6 shows the first step of the insertion of the cross beam, wherein the connector on one end of the beam is inserted into the slot to permit the cross beam to be rotated into position.

FIG. 7 shows the cross beam after it is shifted horizontally to where the hook in the connector at each end of the cross beam is vertically aligned with the web on the main beam.

FIG. 8 shows the cross beam locked in position to the cross beams, after the cross beam was moved vertically downward.

DETAILED DESCRIPTION OF THE PREFERRED EMBODIMENTS

Figure 1:
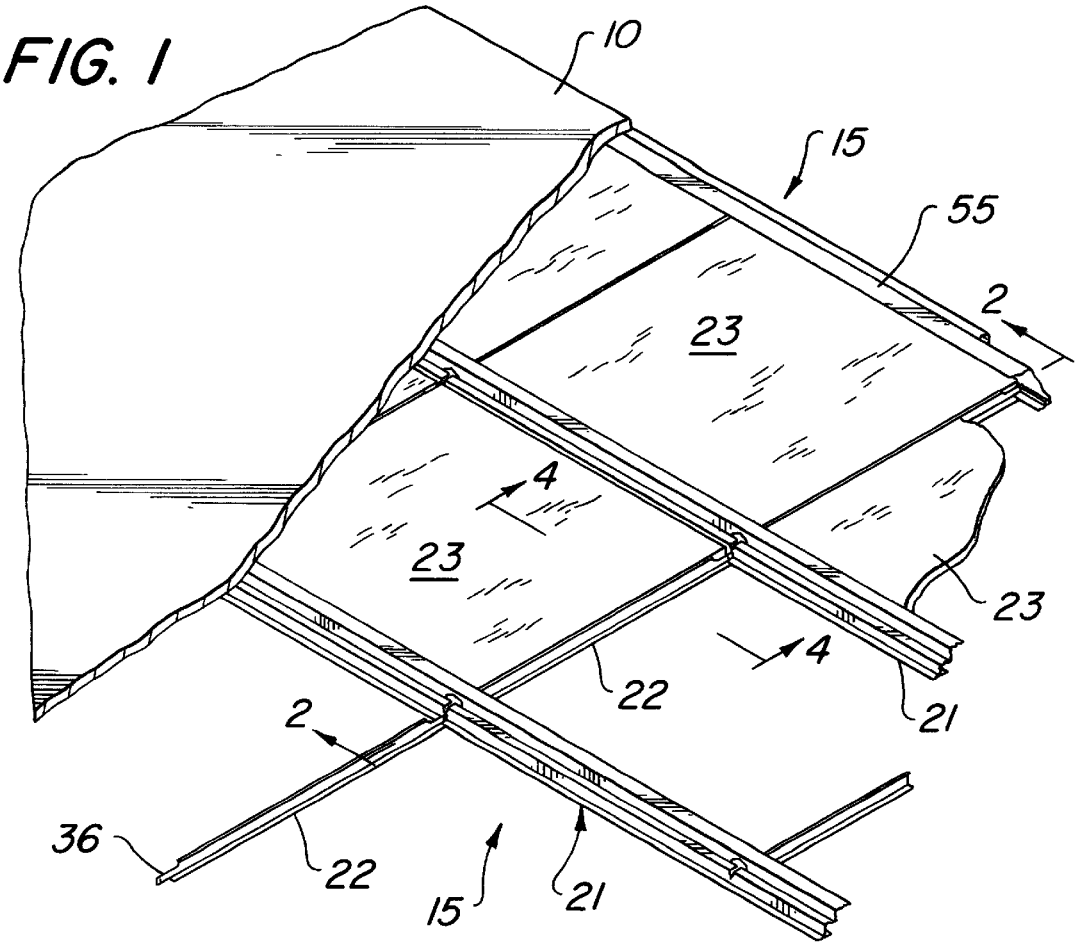
FIG. 1 is a perspective view from above the ceiling.
Figure 3:
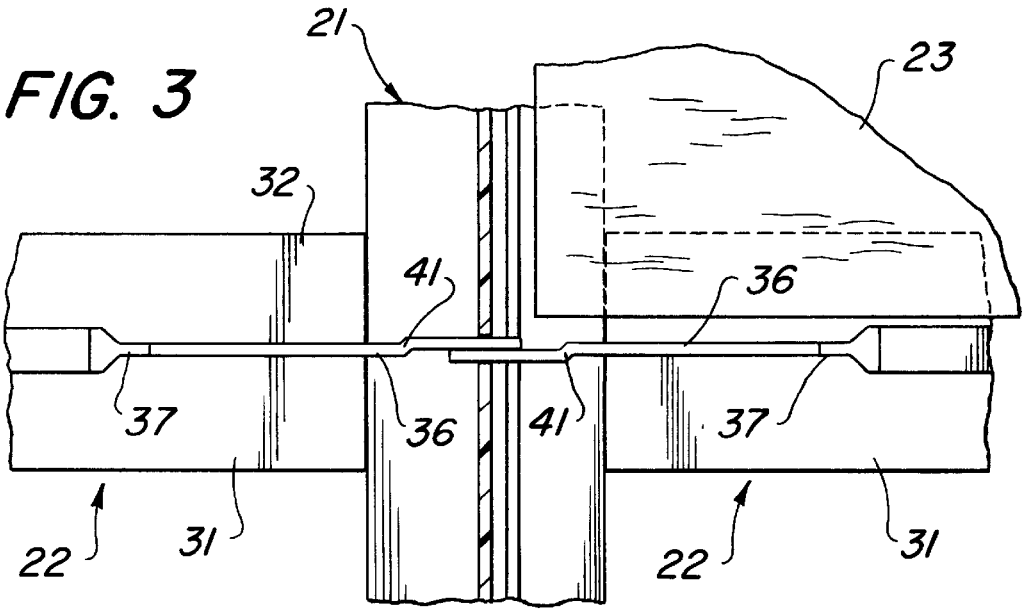
FIG. 3 is a horizontal section taken on the line 3—3 in FIG. 2A.

The grid of the invention is attached to an existing overhead structure 10. This can be, for instance, an existing ceiling 11, as seen in FIGS. 1 through 14, or overhead wooden beams 12, as seen in FIG. 15. The only requirement of such overhead structure 10 is that it be strong enough to support the weight of the ceiling 15 of the invention, which includes a grid 20 of the main beams 21 and cross beams 22, and ceiling panels 23.

Figure 16:
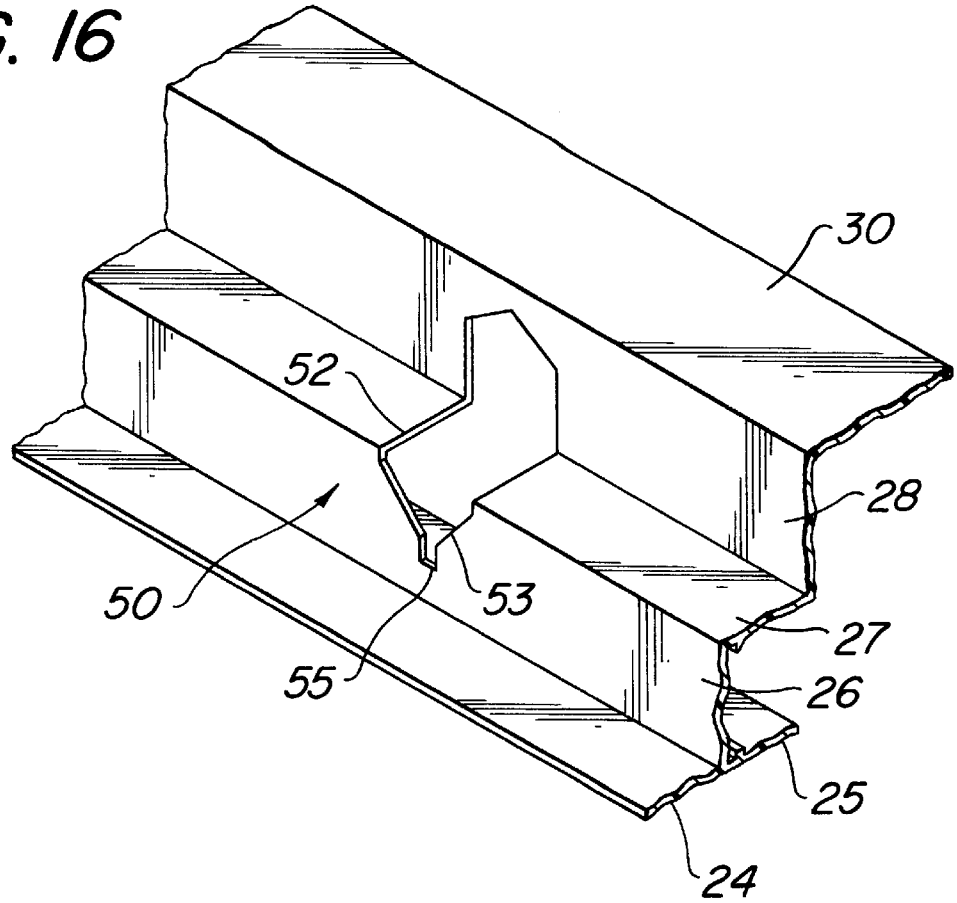
FIG. 16 is a perspective view of a section of main beam showing the slot of the invention.
Figure 17:
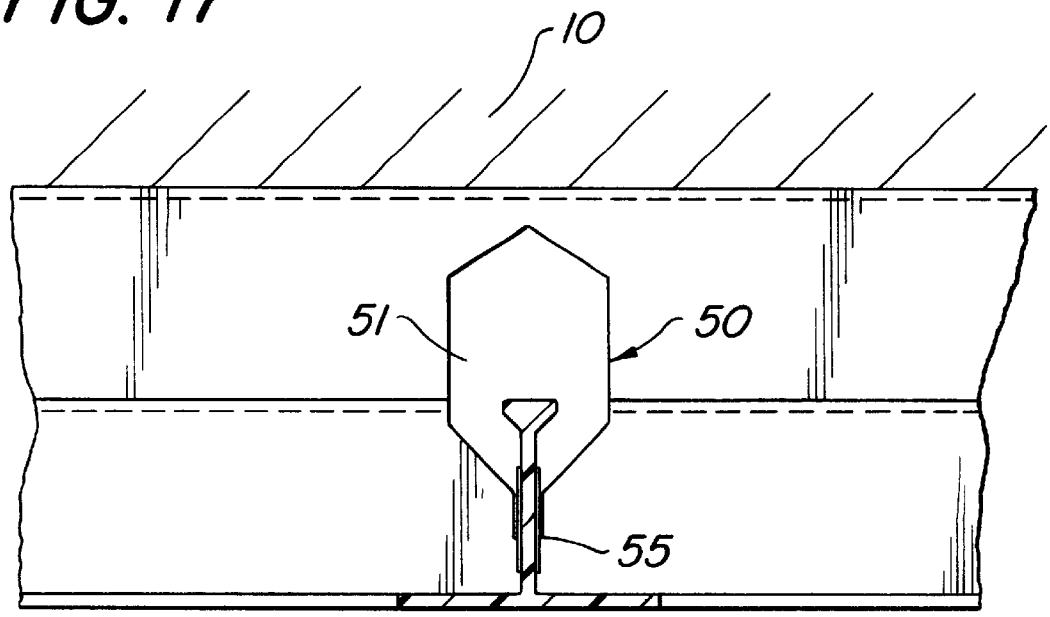
FIG. 17 is a vertical section showing a cross beam locked to a main beam.

Main beam 21 can be of any suitable length, but a desirable length is 96 inches. Main beam 21 has a stepped cross-section as seen, for instance, in FIG. 16. In beam 21, flanges 24 and 25 extend horizontally from vertical web 26. Web 26 has extending perpendicularly from the web, to one side thereof, in a horizontal plane, lower step 27. Extending vertically upward from lower step 27 is riser 28. Extending horizontally outward from riser 28 is upper step 30. A space 29 is created by lower step 27, which offsets riser 28.

Suitable dimensions could be, for Instance, a combined flange width of 1", a web height of ⅔", a lower step width of ½", a riser height of ¾", and an upper step width of ⅝". Where the beam is of extruded plastic of a stiff type, the wall thickness of the various elements in the cross-section of the beam could be 1/20" thick. These dimensions are merely illustrative.

The cross beams 22 have a cross-section with flanges 31 and 32, and a web 33. A rib 35 extends along the top of cross beam 30.

A connector 36 is formed at the end by cutting out part of the web 33 and rib 35 at 37. Also part of flanges 31 and 32, and web 33, are cut out at the end at 38. The remaining part of web 33 at the end of the connector is formed into a hook 40. Also, the end is slightly offset at 41 to permit opposing connectors 36 to remain in line, when connected to a main beam 21, as explained below.

The cross beams 22 are desirably of a 24 inch length between hooks 40 at the ends of a connector 36, to support a 24 inch ceiling panel 23.

A main beam 21 has spaced at, for instance, 24 inch intervals along the length, a stepped access slot 50. The slot 50 has a portion 53 that extends in the vertical web 26 through a portion 52 that extends in the horizontal lower step 27 and optionally through a portion 51 that extends in the vertical riser 28. Portion 51 may be connected to portion 52, or it may be isolated from portion 52, but in either case, it will be aligned with portion 52. However, it is only essential to the invention that the slot 50 extends in the vertical web 26 and through step 27, since the cross beams 22 can be maneuvered into place without passing the connector 36 through the slot 50 in riser 28.

Portion 51 of stepped slot 50 in the vertical riser 28 extends about a vertical center line from the bottom of the riser 28 to near the top, suitably having a peak at the top of the slot 50. The slot 50 can be, for instance, of a width slightly greater than the ½" of the flanges on the cross beam 22 to permit the connector 36 to be inserted through the slot 50 when inserting the cross beam 22 into place, as explained below. The height of the slot 50 portion in the riser 28 can be, for instance, 6/10" to permit the connector 36 to pass into the slot 50 without interference.

Portion 52 of stepped slot 50 optionally extends entirely across lower step 27, with the same width, that is slightly greater than ½", for instance, as that of slot portion 51.

Portion 52 of stepped slot 50 continues into the vertical web 26, at slot portion 53. It is critical to the invention that portions 52 and 53 be continuous, so that connector 36 can pass downward to connect onto web 26. The slot portion 53 narrows from the width of the slot at the top, which conforms to the width of the slot in lower step 27. The slot portion in the web tapers at a 45° angle to a tail portion at 54.

Figure 2:
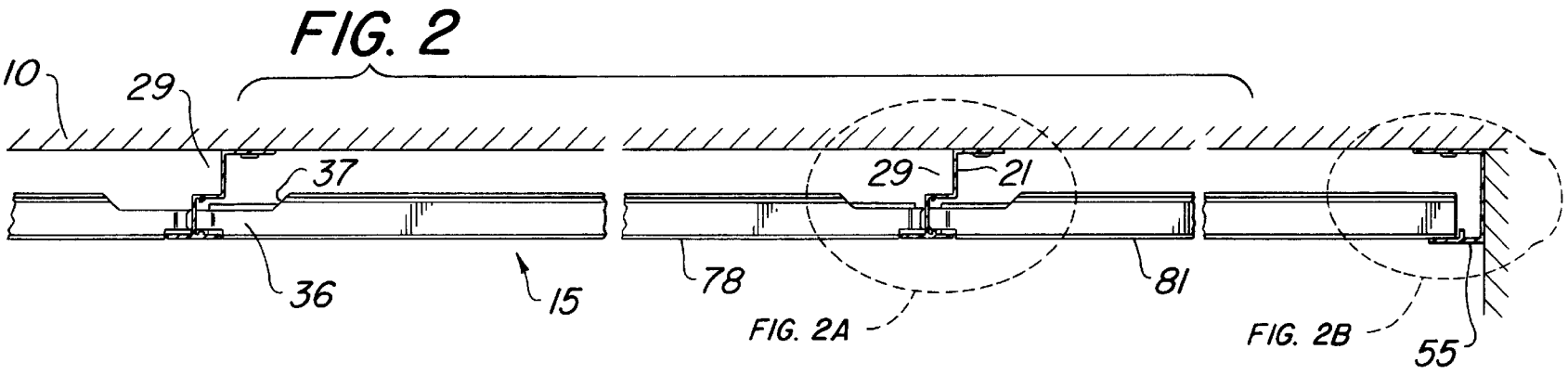
FIG. 2 is a vertical section taken on the line 2—2 of FIG. 1.
Figure 2B:
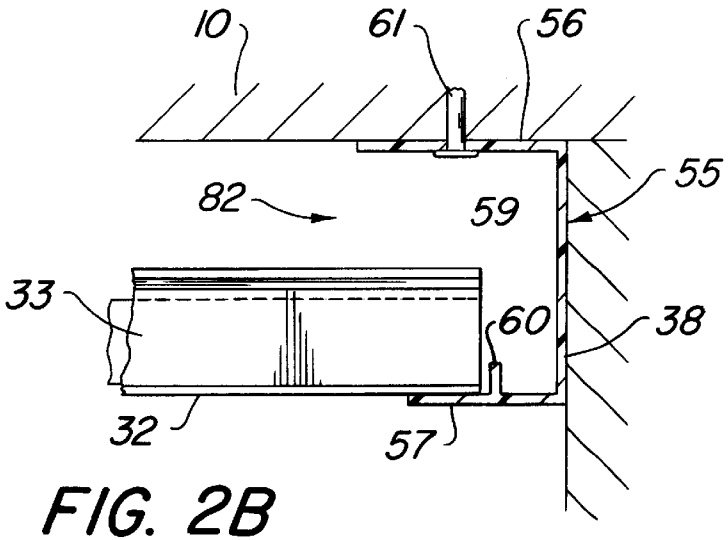
FIG. 2B is an enlargement of the designated encircled portion of FIG. 2.
Figure 2A:
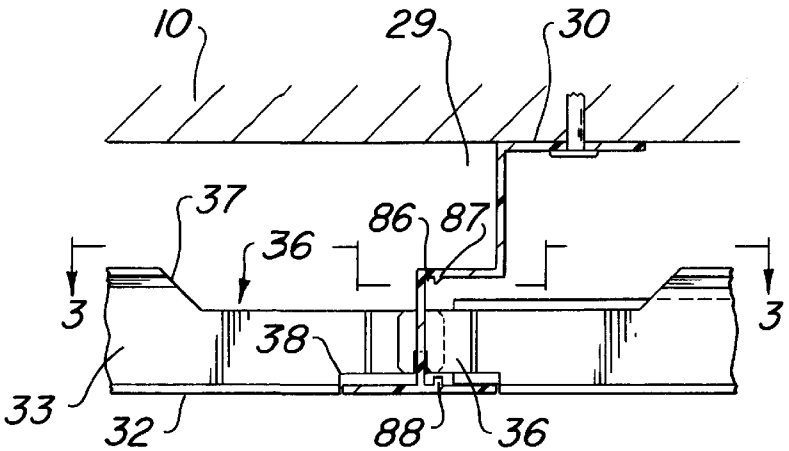
FIG. 2A is an enlargement of the designated encircled portion of FIG. 2.
Figure 4:
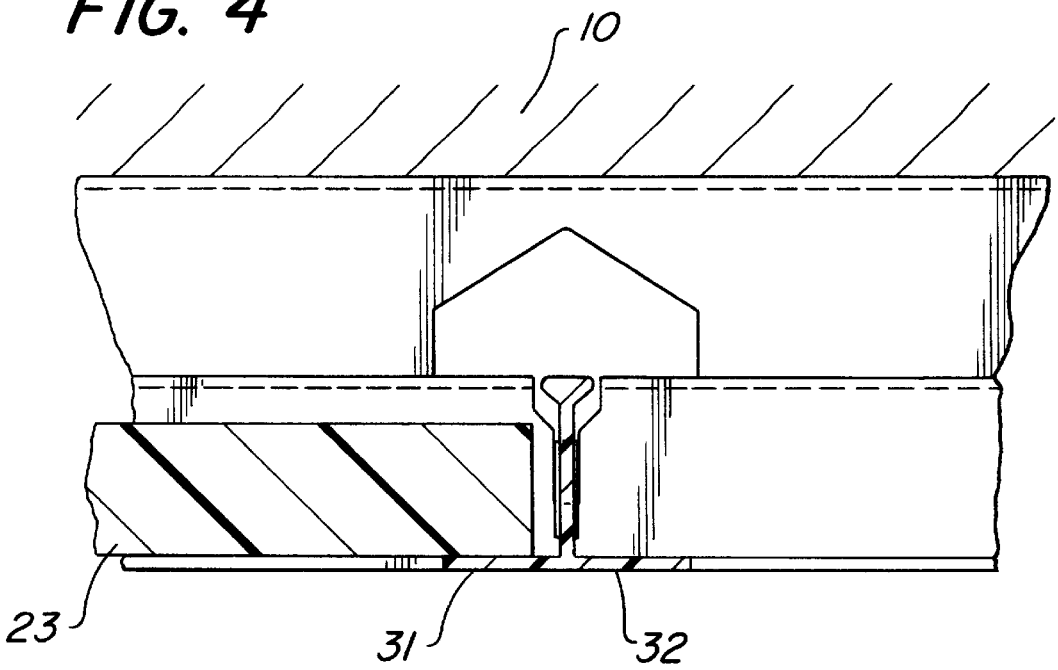
FIG. 4 is a vertical section taken on the line 4—4 in FIG. 1.
Figure 5:
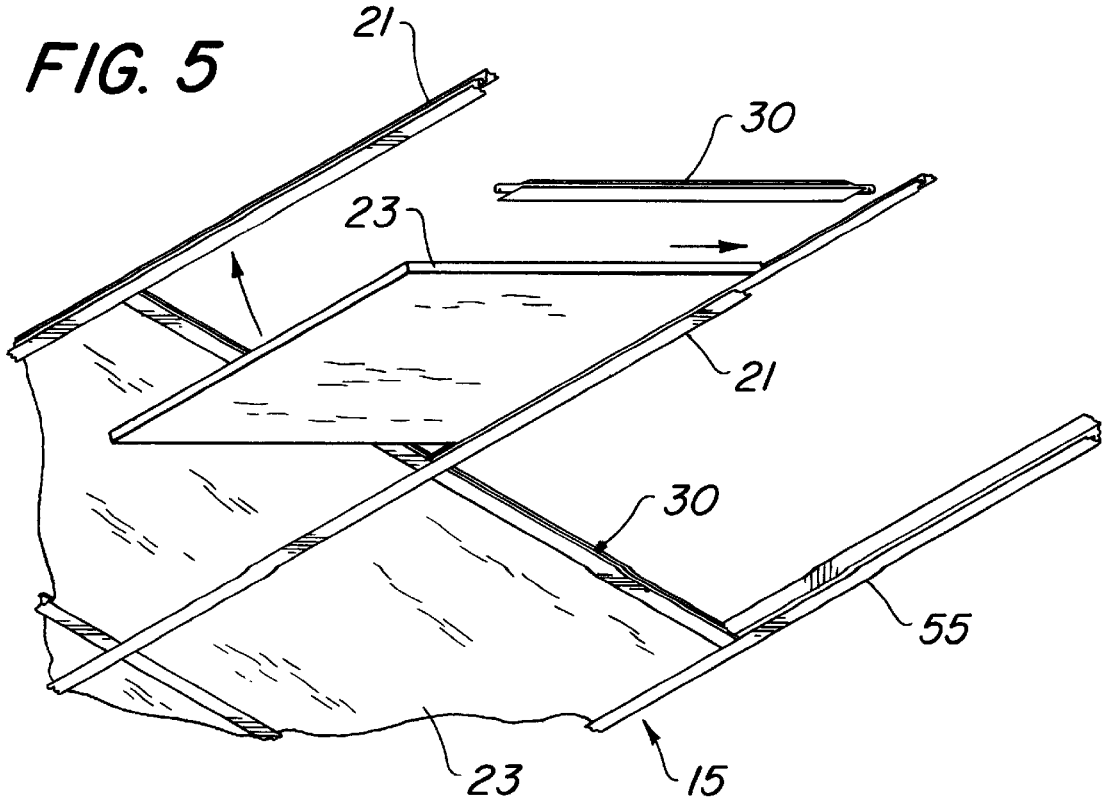
FIG. 5 is a perspective view from below a ceiling showing a panel being inserted into position.

The ceiling 15 of the invention uses a perimeter strip 55, as best seen in FIGS. 2 and 2B. The strip is in a U shape, having legs 56 and 57 extending from base 58. A spacer rib 60 extends from leg 57 to position a ceiling panel 23. Legs 56 and 57 extend horizontally when the strip 55 is in position, and spacer rib 60 extends vertically. Alternatively, upper leg 56 may be omitted.

In assembling the ceiling 15 of the invention, the main beams 21 are affixed to the overhead structure 10 in a parallel relationship, desirably 24" apart. The structure 10 can be appropriately marked, as by chalk lines, to indicate where the main beams are to be attached, working from the center outward. The perimeter strip 55 is affixed to the edge of the structure 10 entirely around the room perimeter with fasteners 61, either through leg 56, or base 58. Main beams 21 are spliced at their ends by a suitable insert 85 that aligns the beams by slipping into groove 86 formed by ridges 87 and 88 formed in flange 25 and lower step 27 by, for instance, extruding, where the main beam itself is of extruded plastic. A bump 90 keeps the insert in place in the groove.

Main beams 21 are longitudinally positioned so that slots 50 line up laterally of the beams, and extend across the ceiling in a line that extends perpendicularly to the length of the parallel main beams, at 24" intervals.

The main beams 21 are affixed to the existing ceiling 10 or overhead structure 11 with screws 61 or other suitable fasteners.

The upper step 30 of each of the main beams 21 extends, as viewed, for instance, in FIG. 2, in the same direction. In FIG. 2, the upper steps 30 are shown extending to the right, but permissibly, the steps may all extend to the left. The procedure to be described would be performed in mirror image fashion with left extending upper steps 30.

After the main beams 21 and perimeter strip 55 have been affixed to the overhead structure 10, the panels 23 and cross beams 22 are inserted. Beginning at one end of a row 78 between main beams 21, a first panel 23 will be inserted between the main beams 21 as seen, for instance, in FIGS. 9 through 14. A panel 23 is first shifted diagonally in a direction shown by arrow 65 into a space at 29 created by the lower step 27. the panel 23 is now free to be rotated in the direction shown by the arrow 66 to the positions shown in FIGS. 11 and 12. The panel is then shifted in the direction of arrows 67 and 68 into the position shown in FIGS. 13 and 14, where it rests on flanges 24 and 25.

A cross beam is then inserted onto a pair of main beams 21. One way is to point a cross beam 22 diagonally upward to the left of a row 78 as orientated in FIG. 2, and hook the left end of the cross beam 22 onto the left main beam 21 in the row. The connector is hooked through a stepped slot 50. The right downward end of the cross beam 22 is brought toward the installer, away from the installed panel until the right end clears the flange on the right main beam in the row. The right end is then moved vertically upward into the space created by stepped portion 29, above slot 50.

The hook on the right end of the cross beam 22 is then moved vertically downward, through slot 50, to hook onto web 26.

During the insertion of cross beam 22 as described, in order to clear the panel 23 which is in place, it is necessary to slightly lift the panel corner.

Figures 6, 7, 8:
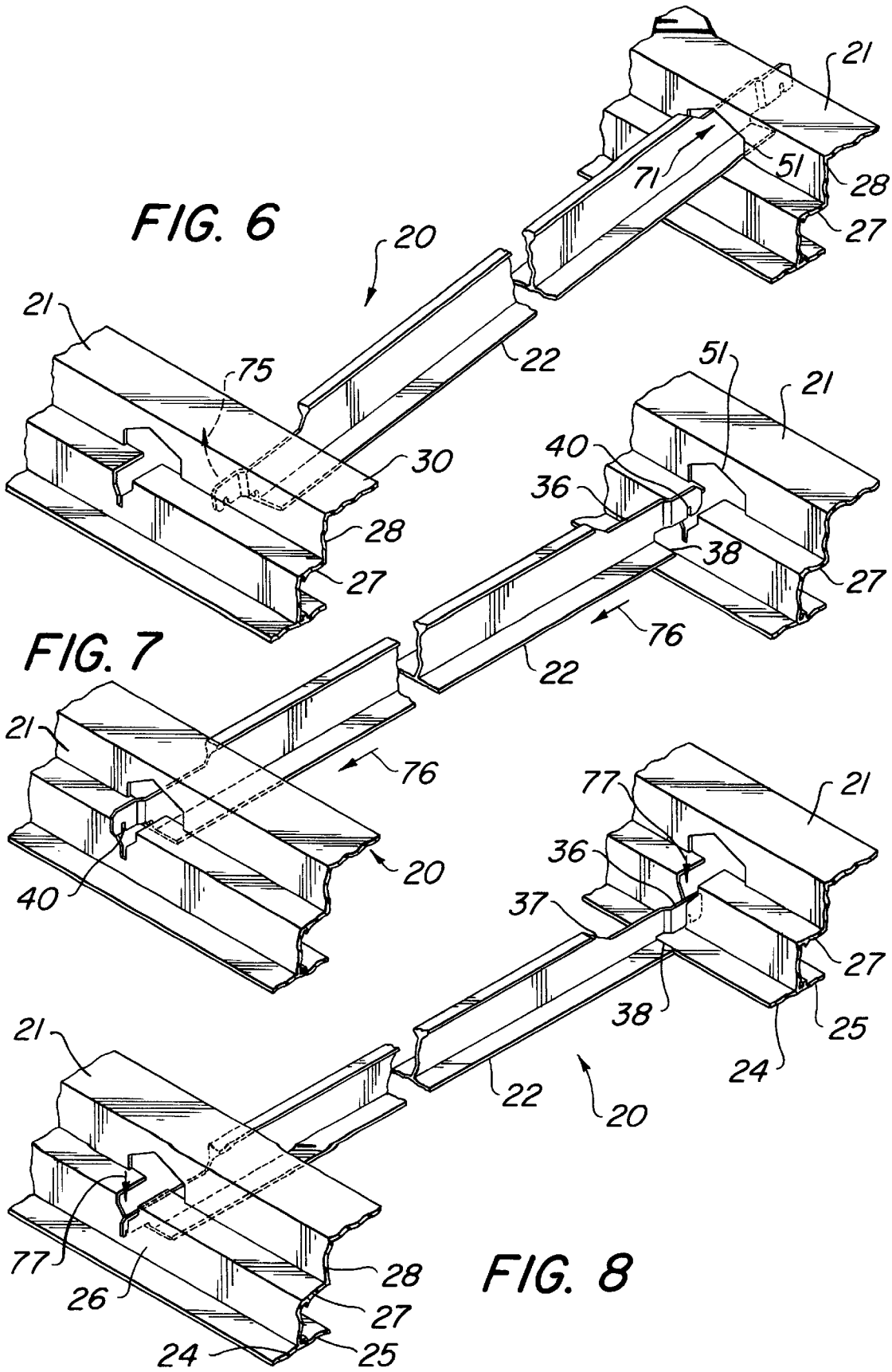
FIGS. 6, 7, and 8 show the steps of a way to insert and lock a cross beam into the ceiling grid, particularly where the cross beam is confined on both sides by panels.
Figure 9:
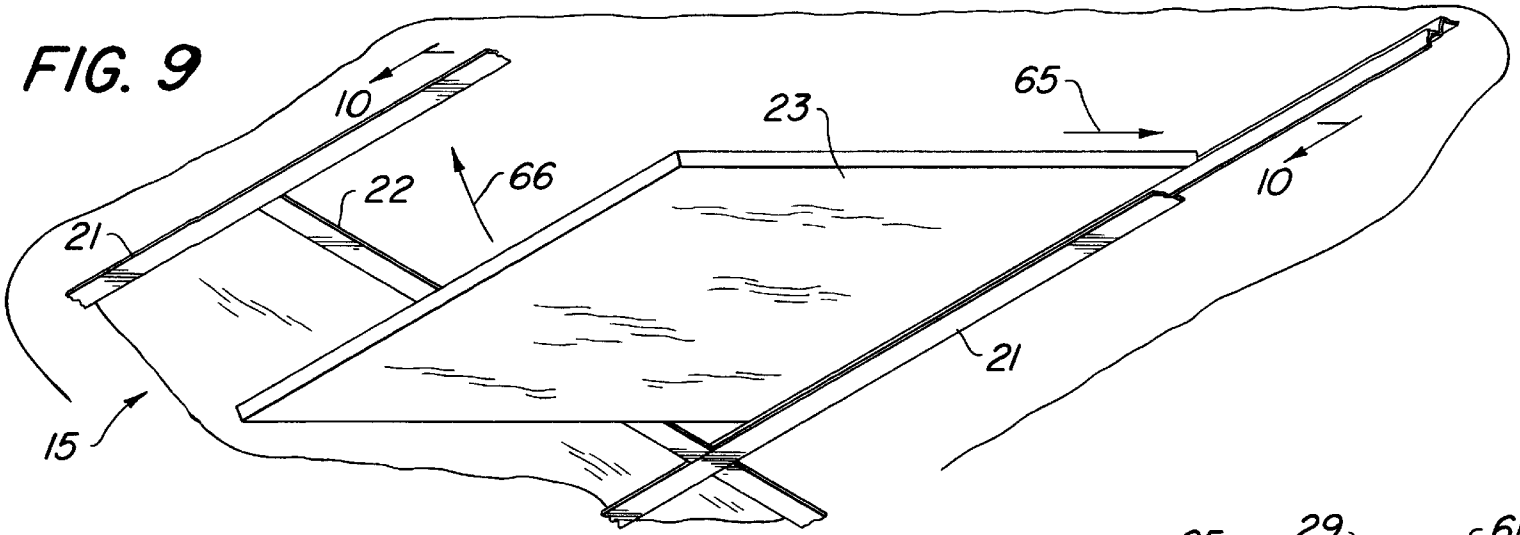
FIG. 9 is a perspective view taken from below a ceiling showing a panel being inserted into place between the main beams.
Figure 10:
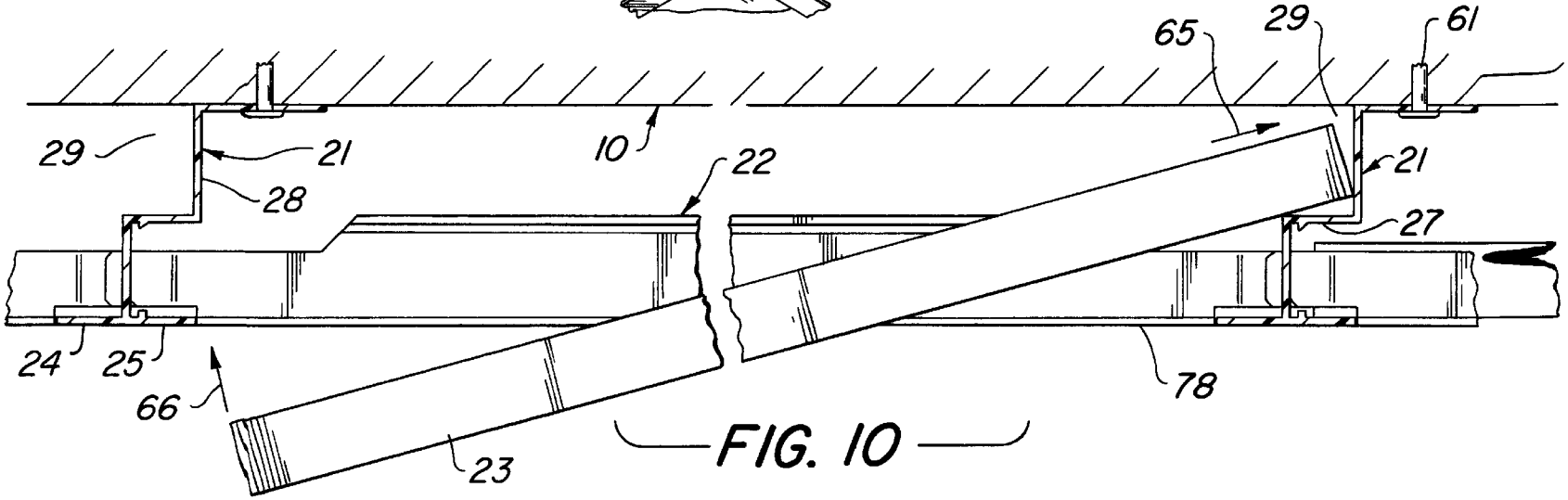
FIG. 10 in a vertical section taken on the line 10—10 of FIG. 9.
Figure 11:
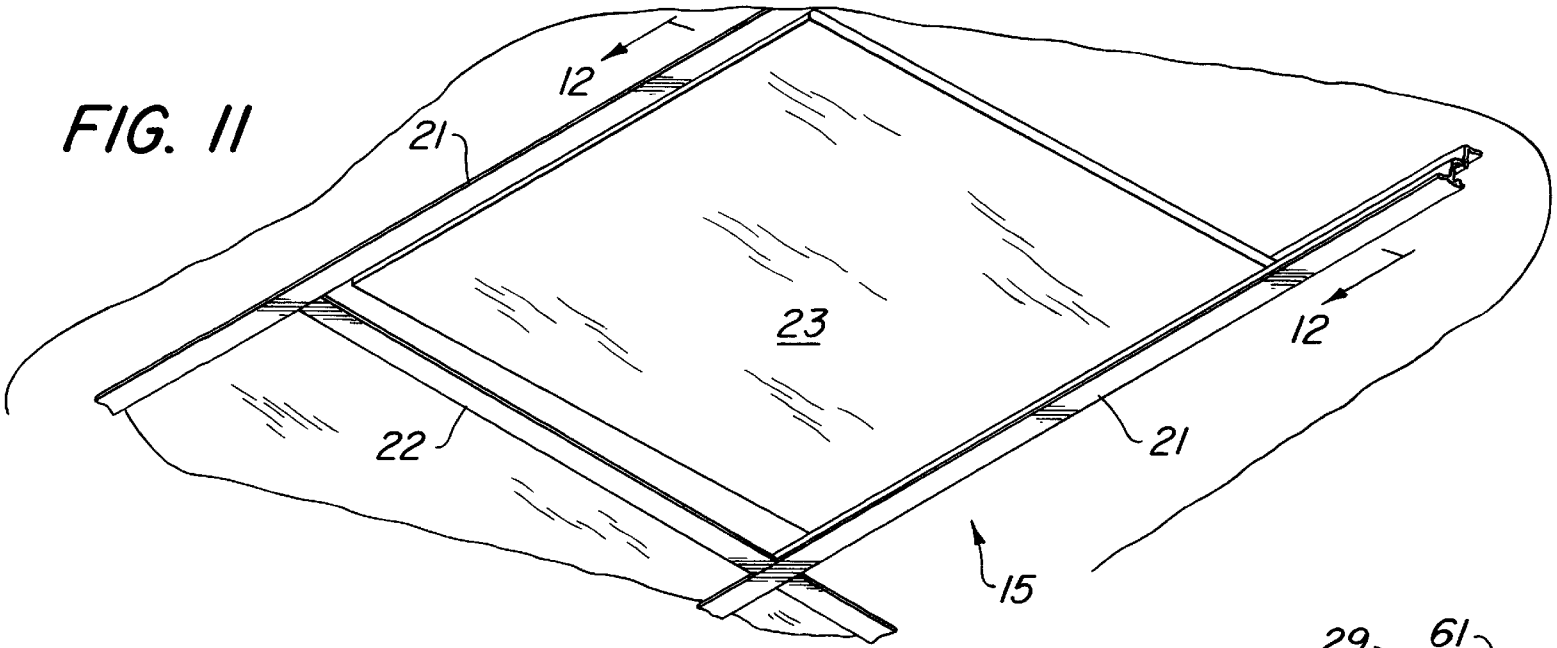
FIG. 11 is a perspective view taken from below showing a panel about to be finally placed into position.
Figure 12:
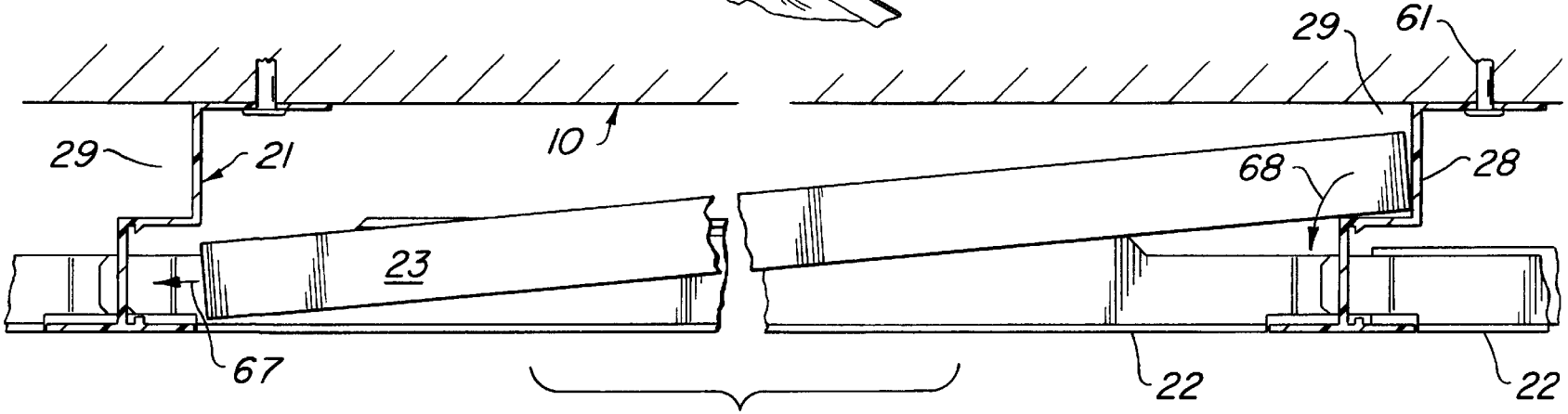
FIG. 12 is a vertical section taken on the line 12—12 in FIG. 11.
Figure 13:
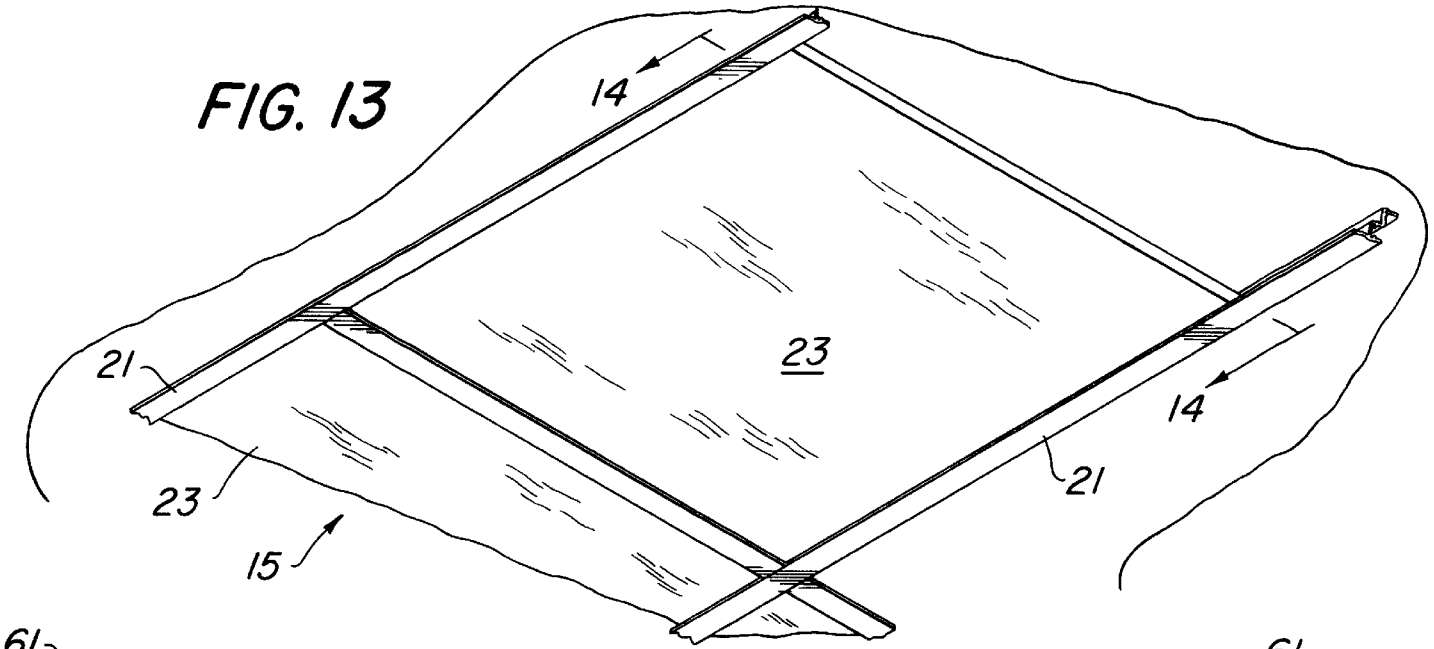
FIG. 13 is a perspective view taken from below showing a panel in place between the main beams.

Alternatively, a cross beam 22 can be inserted as shown in FIGS. 6 through 8. A connector 36 at one end of the cross beam 22 is inserted through slot portion 51 in the riser 28, in the direction of arrow 71. The connector 36 at the opposite end of the cross beam 21 at 73, is rotated upward, as shown by arrow 75. The cross beam is then shifted horizontally, as shown in FIG. 7, by arrows 76, and then moved downward as shown by arrow 77 in FIG. 6. Hooks 40 are locked to web 26 so that the cross beam 22 is locked laterally and longitudinally to the main beams 21.

In many instances, it may be desirable to move a panel already in the ceiling, out of the way before installing a cross beam. A panel can be lifted and shifted into the horizontal space created by space 29 and slid over adjacent panels and cross beams. Such a procedure would be necessary to place the last remaining cross beam in a ceiling row. Panels can be shifted back after the cross beams are in place.

The ability to so shift panels into the horizontal space created by space 29 is of importance. It permits simpler cross beam application, especially in placing the last cross beam in a row. It will enable access to any place above the ceiling. Further, it permits the disassembly of any portion of the ceiling.

Figure 14:
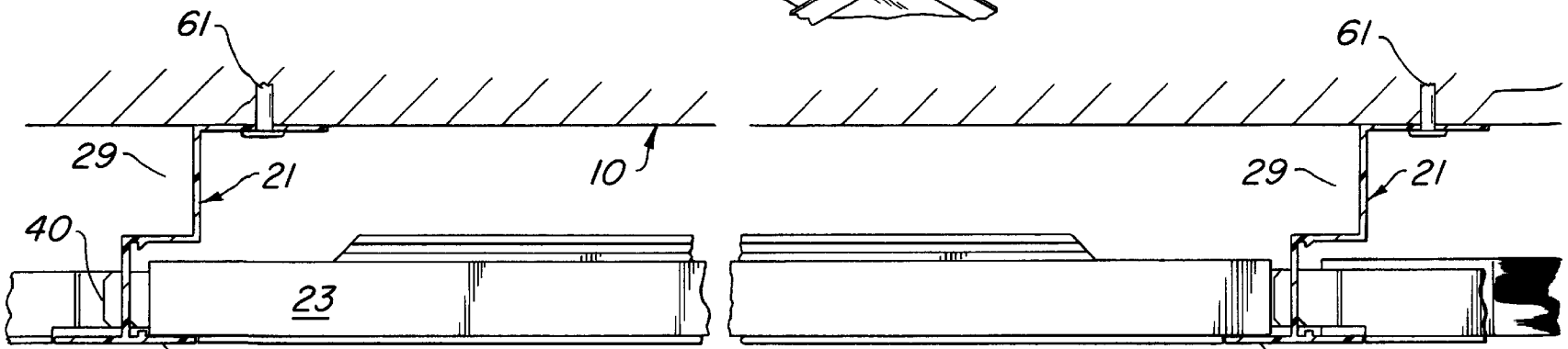
FIG. 14 is a vertical section taken on the line 14—14 of FIG. 13.
Figure 15:
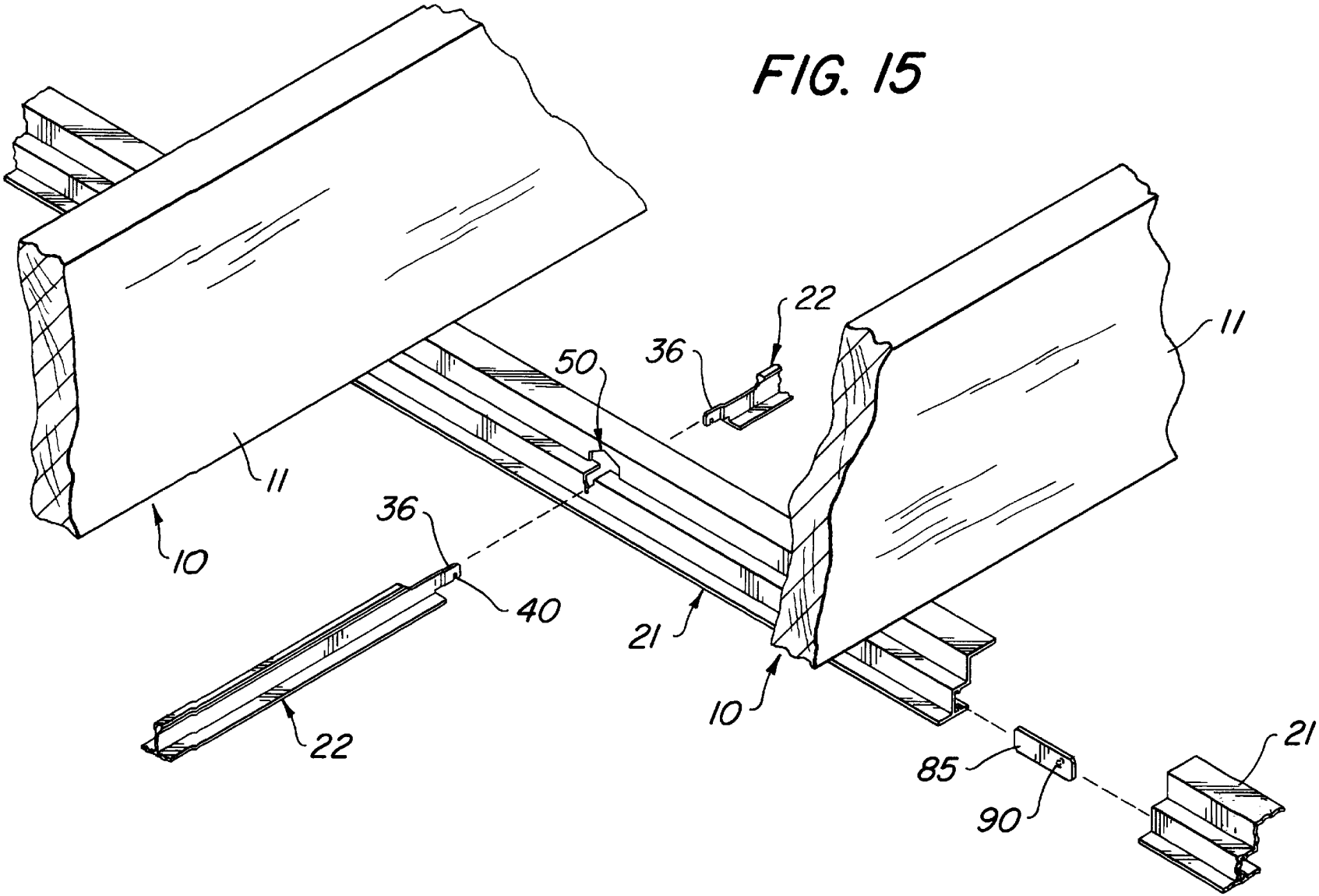
FIG. 15 is an exploded perspective view taken from above showing a portion of the grid attached to an overhead structure.

In the event the invention is practiced without a slot portion in the riser 28, the cross beam will be only shifted into the space created by the lower step 27, and the opposite connector at the left as seen in FIG. 14 will be maneuvered into place by movement in a plane parallel to the plane of the suspended ceiling 15.

When cross beam 22 is in place, panel 23 will be uniformly and securely positioned and supported in place.

The panels are inserted throughout the ceiling in the full rows 78 where the span between main beams is 24". The rows 81 which lie at the sides of the ceiling 15, having a main beam 21 at the left, and a perimeter strip 55 at the right, as seen in FIG. 2, will virtually always be less than 24". As described above, the rows are preferably laid out from the middle of the ceiling outward, so that it would be entirely coincidental if the edge rows were 24 inches, in which case the procedure described above for the rows 78 between main beams would be followed. The panel and connector 36 at the end of the cross beam 22 would be shifted into space 82, as seen in FIG. 2B in the perimeter strip. The connector would be hooked onto spacer rib 60 in the manner that the connector is hooked onto the web of a main beam 21.

In virtually all cases, however, where the ceiling is laid out from the middle outwards, row 81, as seen in FIGS. 2 and 2B, will be less than 24". To lay the panels and cross beams in such a row, a panel will be cut to the width of the row, as will the cross beams. A cross beam 22 will be cut only at the end that engages the perimeter strip 55, and will simply be cut squarely at the desired length, as seen in FIGS. 2 and 2B. The space 59 in the perimeter strip 55 can be used to insert the cut cross beam 22, as well as the panel 23, in the same manner as space 29 created by lower step 27 is used in a main beam. The cut cross beam simply lies on the leg 57, as shown in FIG. 2B, slightly short of spacer rib 60, and does not lock onto the spacer rib 60. The cut cross beam, however, does lock into the stepped slot 50 at the end opposite the cut, so that, again, the panel 23 and cross beam 22 are uniformly positioned without judgment on behalf of the installer.

At the end of the row opposite the start of the row, a panel 23 is cut to accommodate the last space left when inserting a row, and the panel 23 simply rests on the leg 57 of the perimeter strip 55, slightly short of the spacer rib 60. Rib 60 will prevent a panel from shifting off of the main beam flange 25, on which it is supported.

A panel, or panels, can be removed anywhere in the ceiling by simply reversing the steps set forth above. The panels, as well as the cross beams that are removed, can be stored in the ceiling by sliding the panels into the space above the adjacent panels that are already in place. This allows access to the overhead structure, for instance for repair, after which the stored panels and cross beams can be put back in place.

What is claimed is:

1. In a ceiling having parallel extending main beams directly attached to an overhead structure, each of the main beams having in cross-section an upper stepped portion with an upper tread, a riser, and a lower tread, integral with a lower portion with a vertical web and horizontal flanges at the bottom of the web; the improvement comprising a plurality of spaced stepped slots in each of the main beams; each of the stepped slots having a slot portion in the web connected to a slot portion in the lower tread, wherein a cross beam having a connector at the end can be inserted through the slot and connected to the web.

2. A ceiling of claim 1, wherein each of the stepped slots also includes a slot portion in the riser connected to the slot port ion in the lower tread.

3. A ceiling of claim 1 wherein the connector on the end of the cross beam has a hook that connects onto the web of the main beam.

4. A ceiling of claim 2, wherein the slot portion in the riser permits a connector on the end of a cross beam to be inserted laterally from the side of the web beneath the stepped portion of the main beam.

5. A ceiling of claim 1 wherein the connector has a hook that engages the web at the lower end of the slot.

6. A ceiling of claim 1 produced of plastic by an extrusion process.

7. A ceiling of claim 6 having the slots cut into the beam.

8. A ceiling of claim 1 in combination with a perimeter strip having a shape that includes a base extending vertically in the ceiling, and a leg extending horizontally from the base, with a spacer rib extending upwardly from the leg.

9. The ceiling of claim 8, wherein the perimeter strip is of a U-shape.

10. In a group of component parts first capable of being assembled in the field into an intersecting connection in a ceiling grid that supports panels, and then capable of being disassembled from the connection, the group having:

a main beam, capable of being directly attached to an upper structure, having in cross-section an upper stepped portion with an upper tread, a riser, and a lower tread, integral with a lower portion with a vertical web and horizontal flanges at the bottom of the web; and a first and second cross beam, each having a connector at the end;

the improvement comprising a stepped slot in the main beam having a slot portion in the web connected to a slot portion in the lower tread wherein the connector on the first cross beam can be inserted through the slot from one side of the web and connected to the web and the connector on the second cross beam can be inserted through the slot from the other side of the web and connected to the web, with the connectors on the first and second cross beams abutting one another.

11. The group of claim 10, wherein a panel can be shifted and stored above an adjacent panel to provide access above the ceiling.

12. The group of claim 10, wherein a slot portion in the riser is connected to the slot portion in the lower tread.

13. The group of claim 10, wherein the connector on the end of the cross beam has a hook that connects onto the web of the main beam.

14. In a group of component parts first capable of being assembled in the field into an intersecting connection in a ceiling grid that supports panels, and then capable of being disassembled from the connection, the group having:

a main beam having in cross-section an upper stepped portion with an upper tread, a riser, and a lower tread, integral with a lower portion with a vertical web and horizontal flanges at the bottom of the web; and a first and second cross beam, each having a connector at the end;

the improvement comprising (1) extruding the beams from a plastic material, and then (2) cutting out material to form (a.) a stepped slot in the main beam having a slot portion in the web connected to a slot portion in the lower tread, and (b.) a hook connector on the end of each of the cross beams, whereby, in assembling the group, the connector on the first cross beam can be inserted through the slot from one side of the web and connected to the web and the connector on the second cross beam can be inserted through the slot from the other side of the web and connected to the web, with the connectors on the first and second cross beams abutting one another.

15. A group of claim 14, wherein, after cutting a hook connector on the end of each of the cross beams, each connector is offset from the web by stamping.

* * * * *